US011622907B2

(12) United States Patent
Lajoie

(10) Patent No.: US 11,622,907 B2
(45) Date of Patent: Apr. 11, 2023

(54) SUSPENSION SYSTEM FOR ASSISTING A USER TO NAVIGATE A STAIRCASE

(71) Applicant: Sebastien Lajoie, Montreal (CA)

(72) Inventor: Sebastien Lajoie, Montreal (CA)

(73) Assignee: Sebastien LaJoie, Montreal (CA)

( * ) Notice: Subject to any disclaimer, the term of this patent is extended or adjusted under 35 U.S.C. 154(b) by 504 days.

(21) Appl. No.: 16/652,634

(22) PCT Filed: Nov. 23, 2018

(86) PCT No.: PCT/CA2018/051493
§ 371 (c)(1),
(2) Date: Mar. 31, 2020

(87) PCT Pub. No.: WO2019/144215
PCT Pub. Date: Aug. 1, 2019

(65) Prior Publication Data

US 2020/0352814 A1 Nov. 12, 2020

(30) Foreign Application Priority Data

Jan. 23, 2018 (CA) ..... CA 2992675

(51) Int. Cl.
*A61H 3/00* (2006.01)
*A61H 3/04* (2006.01)
*A61G 7/10* (2006.01)

(52) U.S. Cl.
CPC ..... *A61H 3/008* (2013.01); *A61G 7/10* (2013.01); *A61H 3/04* (2013.01);
(Continued)

(58) Field of Classification Search
CPC .... A61H 3/008; A61H 3/04; A61H 2003/001; A61H 2003/007; A61H 2003/043;
(Continued)

(56) References Cited

U.S. PATENT DOCUMENTS 3,408,067 A * 10/1968 Armstrong ..... A63B 22/02 472/91
3,780,663 A 12/1973 Pettit
(Continued)

FOREIGN PATENT DOCUMENTS

CA 2897620 A1 7/2014
DE 102010004656 A1 7/2011

OTHER PUBLICATIONS

European Patent Office, The Extended European Search Report, Application No. 18902892.1, dated Sep. 23, 2021, 9 pages, Germany.

(Continued)

*Primary Examiner* — Garrett K Atkinson
(74) *Attorney, Agent, or Firm* — Lavery, De Billy, LLP; Gonzalo Lavin

(57) ABSTRACT

A suspension system (2) for assisting a user (4) to navigate a staircase (6), the suspension system comprising: a beam (8) positioned above the staircase (6); a carriage (18) displaceable along said beam (8) between a first position at the bottom of the staircase (6) and a second position at the top of the staircase (6); a harness (14) securable to the user (4), said harness (14) being operably connectable to said carriage (18) such that said carriage (18) follows the user (4) as the user (4) navigates the staircase (6); and a brake (42) operably connected to said carriage (18) for braking said carriage; wherein if the user (4) falls while navigating the staircase (6), said brake (42) stops said carriage (18) in place and the user (4) is suspended above the staircase.

14 Claims, 9 Drawing Sheets

(52) U.S. Cl.
CPC .. *A61H 2003/001* (2013.01); *A61H 2003/007* (2013.01); *A61H 2003/043* (2013.01); *A61H 2003/046* (2013.01); *A61H 2201/0176* (2013.01); *A61H 2201/1253* (2013.01); *A61H 2201/1454* (2013.01); *A61H 2201/1652* (2013.01); *A61H 2201/5097* (2013.01); *A63B 2208/029* (2013.01)

(58) Field of Classification Search
CPC ..... A61H 2003/046; A61H 2201/0176; A61H 2201/1253; A61H 2201/1454; A61H 2201/1652; A61H 2201/5097; A61H 2201/165; A61H 3/00; A61G 7/10; A61G 7/1042; A63B 2208/029
See application file for complete search history.

(56) References Cited

U.S. PATENT DOCUMENTS 3,985,082 A 10/1976 Barac
4,204,673 A * 5/1980 Speer, Sr. ..... A63B 22/0292 601/40
4,423,864 A * 1/1984 Wiik ..... A63B 22/203 472/91
4,733,858 A * 3/1988 Lan ..... A63B 21/4047 482/53
5,314,390 A * 5/1994 Westing ..... A63B 21/4034 601/36
5,830,162 A * 11/1998 Giovannetti ..... A61B 5/1038 482/69
5,899,298 A 5/1999 Crouse, Jr.
6,880,487 B2 * 4/2005 Reinkensmeyer ... A01K 15/027 119/728
7,125,388 B1 * 10/2006 Reinkensmeyer ..... A63B 69/0064 601/5
7,381,163 B2 * 6/2008 Gordon ..... A63B 22/02 482/69
7,621,850 B2 * 11/2009 Piaget ..... A63B 21/154 482/54
7,980,856 B2 * 7/2011 Grabiner ..... A63B 24/00 434/258
7,998,040 B2 * 8/2011 Kram ..... A63B 21/055 482/54
8,002,674 B2 * 8/2011 Piaget ..... A63B 23/0429 482/52
8,550,962 B2 * 10/2013 Piaget ..... A63B 22/04 482/52
9,510,991 B2 * 12/2016 Stockmaster ..... A61H 3/008
9,713,439 B1 * 7/2017 Wu ..... A61B 5/221
9,801,775 B2 * 10/2017 Vallery ..... A63B 21/4009
9,901,759 B2 2/2018 Galpin et al.
2004/0143198 A1 * 7/2004 West ..... A61H 1/0262 601/5
2006/0189453 A1 8/2006 Leblond
2006/0229167 A1 * 10/2006 Kram ..... A63B 21/4015 482/54
2010/0124996 A1 * 5/2010 Lindsay ..... A63B 17/04 472/136
2012/0018249 A1 * 1/2012 Mehr ..... A63B 69/0064 182/5
2014/0206503 A1 * 7/2014 Stockmaster ..... A61H 3/008 482/4
2015/0141205 A1 5/2015 Garland
2015/0320632 A1 * 11/2015 Vallery ..... A61G 7/1042 482/69
2016/0052400 A1 2/2016 Mcgowan et al.
2016/0256346 A1 * 9/2016 Stockmaster ..... G16H 40/63
2017/0027803 A1 * 2/2017 Agrawal ..... A61B 5/1122
2017/0112705 A1 * 4/2017 Hornby ..... A61H 3/008
2017/0135893 A1 * 5/2017 Stockmaster ..... A61H 3/008
2018/0055715 A1 * 3/2018 Vallery ..... A63B 21/4009
2021/0069052 A1 * 3/2021 Burke ..... A62B 35/0081

OTHER PUBLICATIONS

International Searching Authority CA, International Search Report and Written Opinion, dated Feb. 18, 2019, 9 pages, PCT/CA2018/051493.

* cited by examiner

SUSPENSION SYSTEM FOR ASSISTING A USER TO NAVIGATE A STAIRCASE

FIELD OF THE INVENTION

The present invention relates to a suspension system for assisting a user with reduced mobility to navigate a staircase.

BACKGROUND OF THE INVENTION

People with reduced mobility, for example senior citizens or people recovering from injuries, often encounter issues when they live in multi-story homes. Climbing or descending staircases can pose many dangers to them as they risk falling and injuring themselves. In addition, due to their reduced mobility, they may simply be incapable of navigating the stairs on their own. While many senior citizens leave their homes and move into seniors' residences at a certain point, these residences are often quite expensive. Further, many senior citizens are opposed to moving into a seniors' residence because they want to maintain their independence.

Currently, there exist multiple systems to assist people with reduced mobility to climb or descend staircases. For example, stair lifts are commonly used to carry people with reduced mobility up and down stairs. While these systems reduce the risk of falling, they are often quite expensive. In addition, many staircases are not compatible for stair lift installations, for example because they are too narrow or follow an abnormal path. Finally, while systems such as stair lifts provide a safe way for people with reduced mobility to navigate staircases, they do not offer the typical cardiovascular benefits that are associated with manually climbing and descending stairs with one's legs.

As such, there exists a need for a system that allows people with reduced mobility to safely navigate stairs without the risk of falling while promoting good cardiovascular health.

SUMMARY OF THE INVENTION

In order to address the above drawbacks, there is provided a suspension system for assisting a user to navigate a staircase, the suspension system comprising: a beam positioned above the staircase; a carriage displaceable along said beam between a first position at the bottom of the staircase and a second position at the top of the staircase; a harness securable to the user, said harness being operably connectable to said carriage such that said carriage follows the user as the user navigates the staircase; and a brake operably connected to said carriage for braking said carriage; wherein if the user falls while navigating the staircase, said brake stops said carriage in place and the user is suspended above the staircase.

In an embodiment, there is also provided method for installing the suspension system, the method comprising steps of: securing the beam to the ceiling above the staircase; securing the carriage to said beam, said carriage being displaceable along said beam between the first position at the bottom of the staircase and the second position at the top of the staircase; and attaching connection means to said carriage, said connection means connecting a harness to said beam, said harness to be worn by the user when navigating the staircase such that said carriage follows the user.

DETAILED DESCRIPTION OF THE ILLUSTRATIVE EMBODIMENTS

Figure 1A:
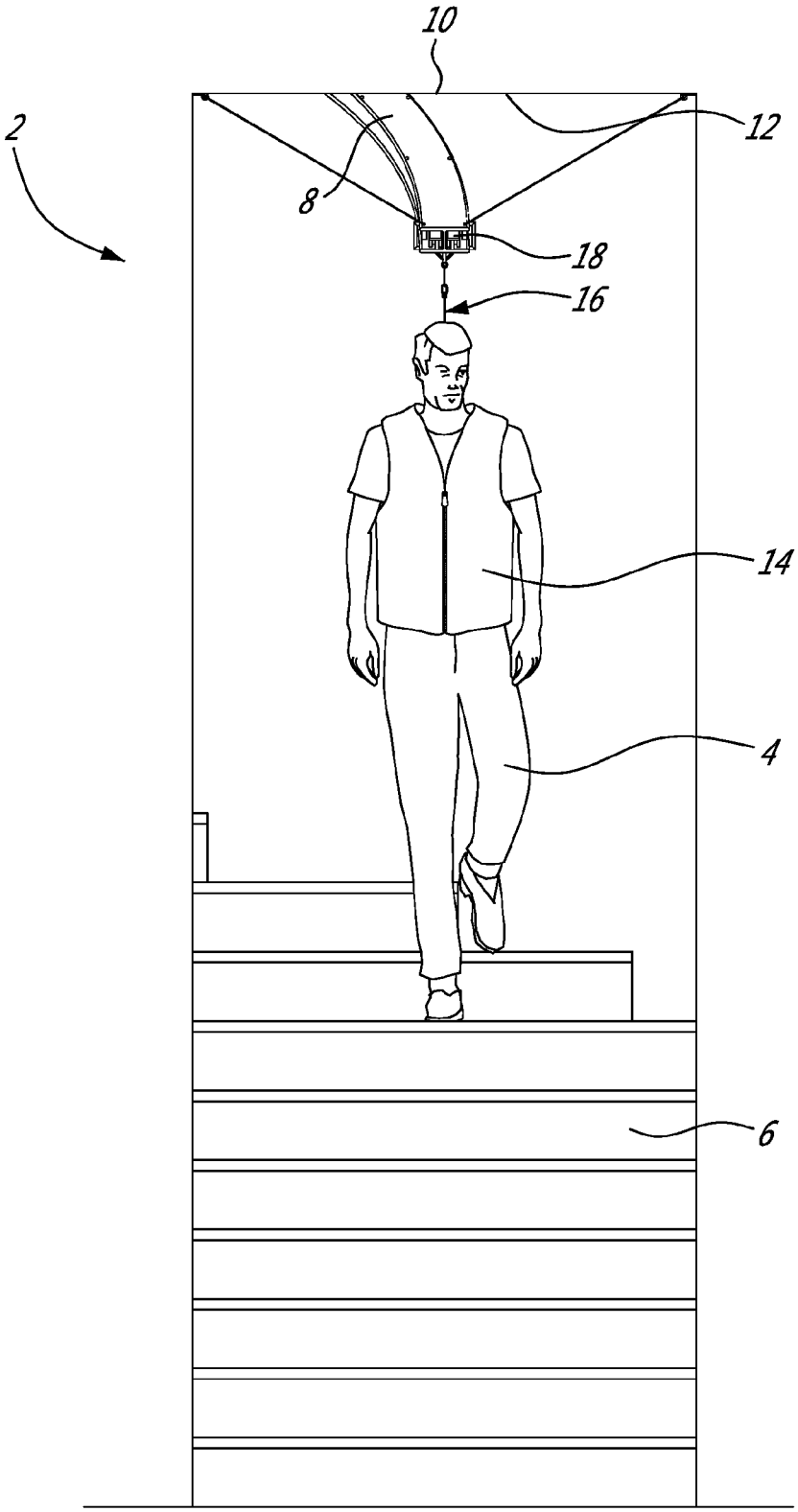
FIG. 1A is a front schematic view of a suspension system, in accordance with an illustrative embodiment of the present invention.

Referring to FIG. 1A, there is shown a suspension system, generally referred to by the reference numeral 2, for assisting a user 4 with reduced mobility to navigate a staircase 6. User's 4 mobility may be reduced due to one or more of a plurality of reasons such as age, illness and injury, among others. The suspension system 2 comprises a beam 8 positioned above the staircase 6 and secured to a ceiling 10 above the staircase 6 by a plurality of anchors 12. When the user 4 wishes to securely navigate the staircase 6, either by climbing or descending the staircase 6, they are provided with a harness 14 linked to beam 8 by connection means 16 and to a carriage 18 displaceable or rollable along the beam 8, as will be discussed in further detail below. As such, the carriage 18 follows the user 4 as they navigate the staircase 6, and if the user 4 were to fall, for example by stumbling, missing a step, or tripping, they will be supported by the suspension system 2 to prevent any possible injuries. In order to follow the user 4, the carriage 18 is slideable along the beam 8 between a first position at the bottom of the staircase 6 and a second position at the top of the staircase 6. In an embodiment, the appearance of the harness 14 resembles a rescue-type safety vest.

Figure 1B:
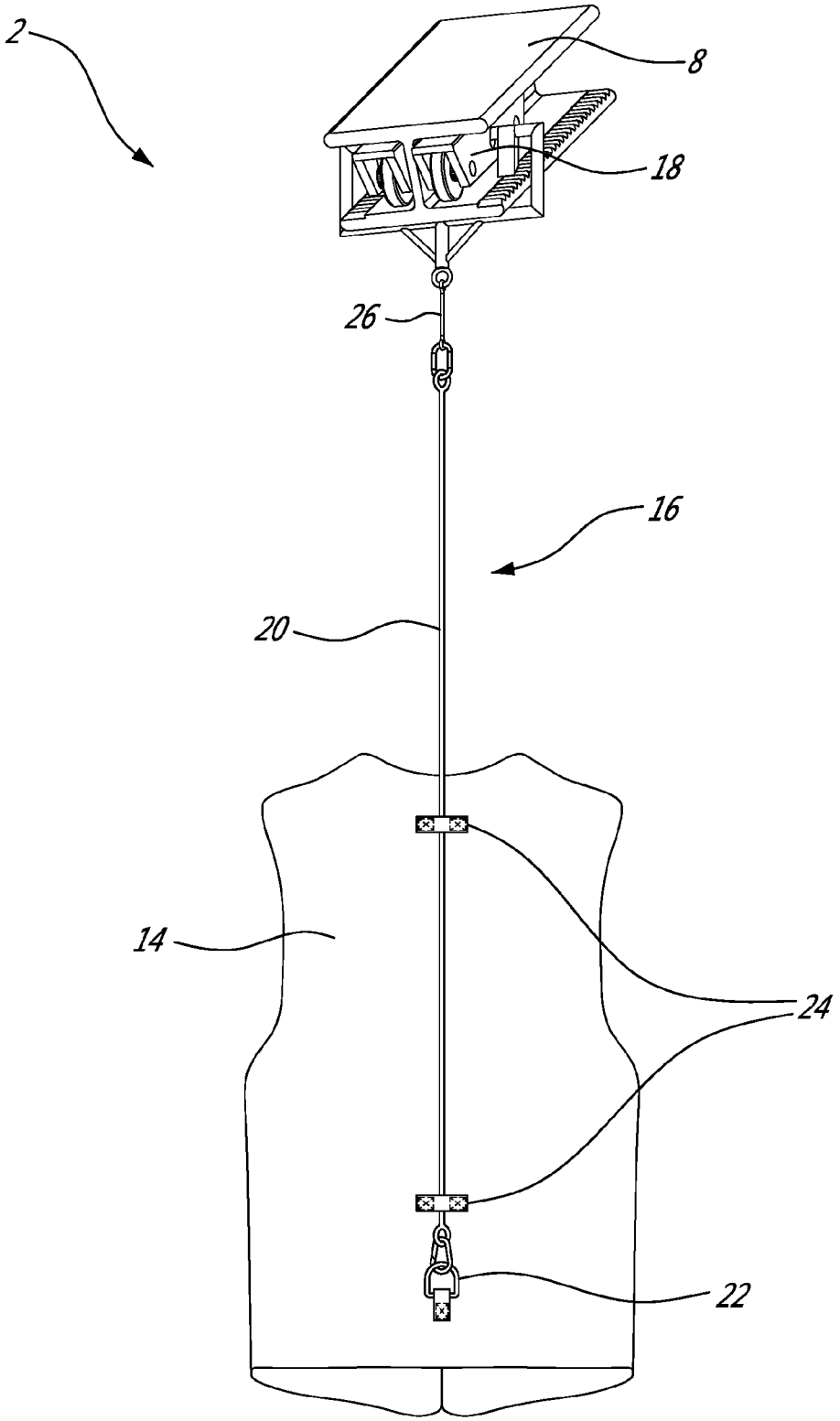
FIG. 1B is a perspective schematic view of a beam-mounted harness for a suspension system, in accordance with an illustrative embodiment of the present invention.

Referring now to FIG. 1B in addition to FIG. 1A, in an embodiment, connection means 16 comprise a semi-rigid rubber rod 20 connected to the harness 14 via a hook 22 comprising, for example, a resealable latch or a carabiner (not shown). At least one clamp 24, illustratively two clamps 24, ensure that the semi-rigid rubber rod 20 remains substantially vertical as the user 4 navigates the staircase 6. As the user 4 navigates the staircase 6, the semi-rigid rubber rod 20 guides the movement of the carriage 18 without impeding the user's 4 movements. Further, an elastic rope 26 connects the semi-rigid rubber rod 20 to the carriage 18. The elasticity of the elastic rope 26 provides greater flexibility to the user 4 as they navigate the staircase 6 and aids in dampening a possible fall of the user 4. In an embodiment, the elastic rope 26 has a length of about three inches.

Figure 2:
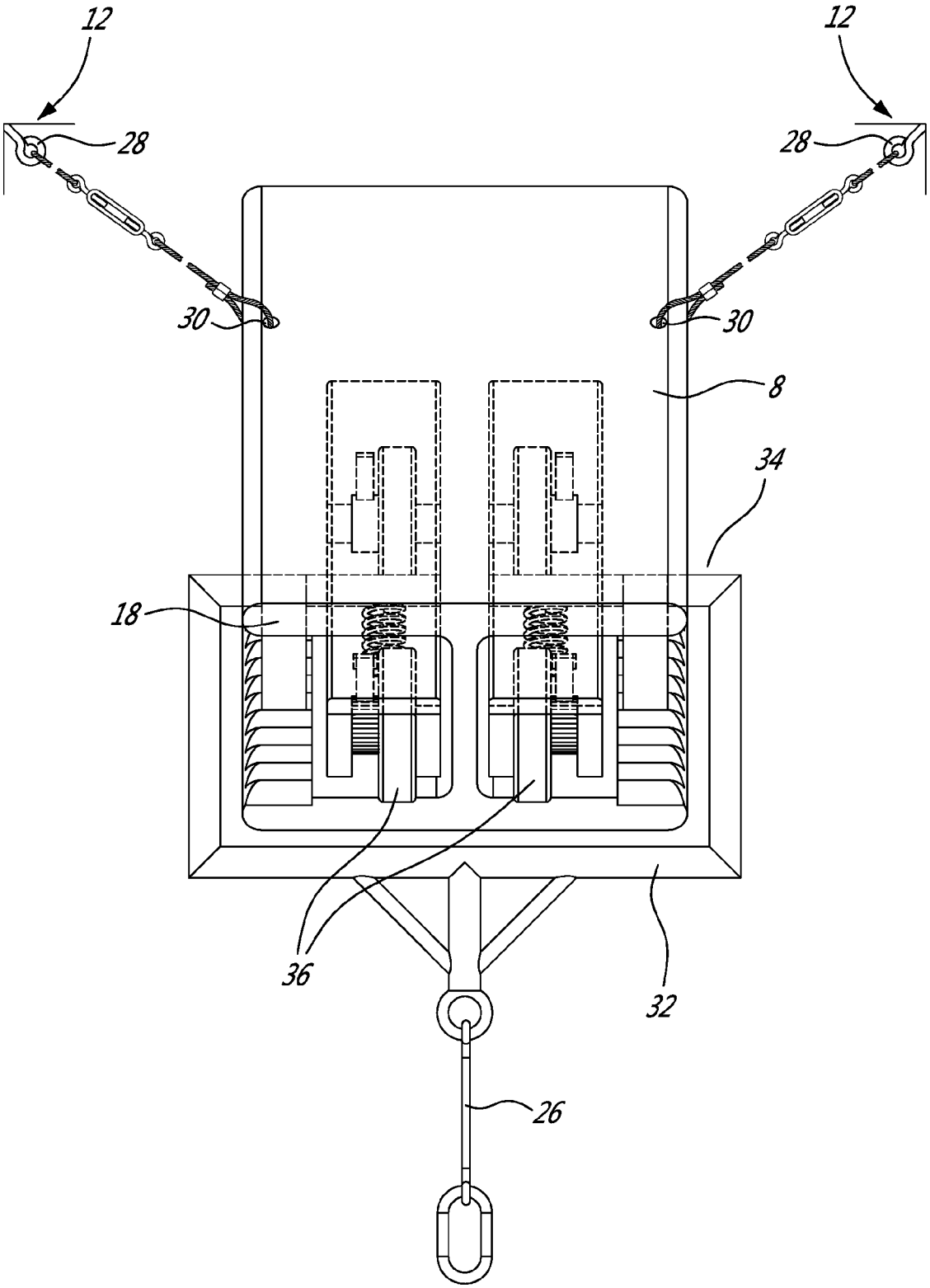
FIG. 2 is a front schematic view of a beam and carriage for a suspension system, in accordance with an illustrative embodiment of the present invention.

Referring now to FIG. 2 in addition to FIG. 1A, each anchor 12 secures the beam 8 to the ceiling 10 via an anchor hook 28 that latches into one of a plurality of pre-fabricated holes 30 in the beam 8. In an embodiment, each anchor 12 comprises a braided steel cable. Further, the carriage 18 connects to a swing 32 via a pivot 34 and the swing 32 connects the carriage 18 to the elastic rope 26. The pivot 34 allows the swing to better follow the motion of the user 4, increasing the flexibility of the carriage 18. Thus, as the user 4 climbs or descends the staircase 6, the pivot 34 allows the swing 32 to rotate which allows the semi-rigid rubber rod (20) to remain substantially vertical regardless of the position of the user 4 on the staircase 6. A plurality of wheels 36 allow the carriage 18 to roll along the beam 8 as the user 4 navigates the staircase 6, as will be discussed in further detail below.

Figure 3A:
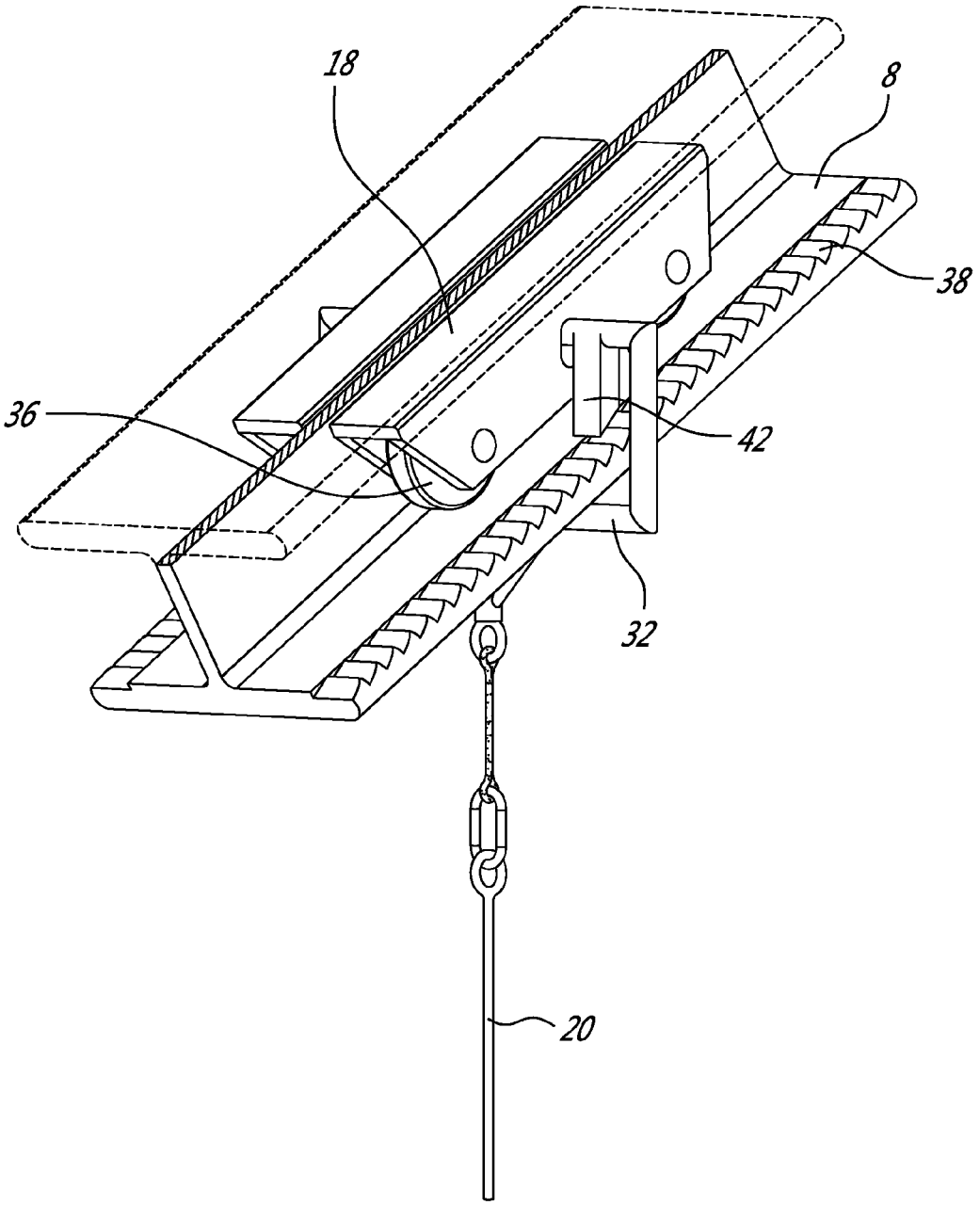
FIGS. 3A and 3B are perspective schematic views of a rolling carriage for a suspension system, in accordance with an illustrative embodiment of the present invention.
Figure 3B:
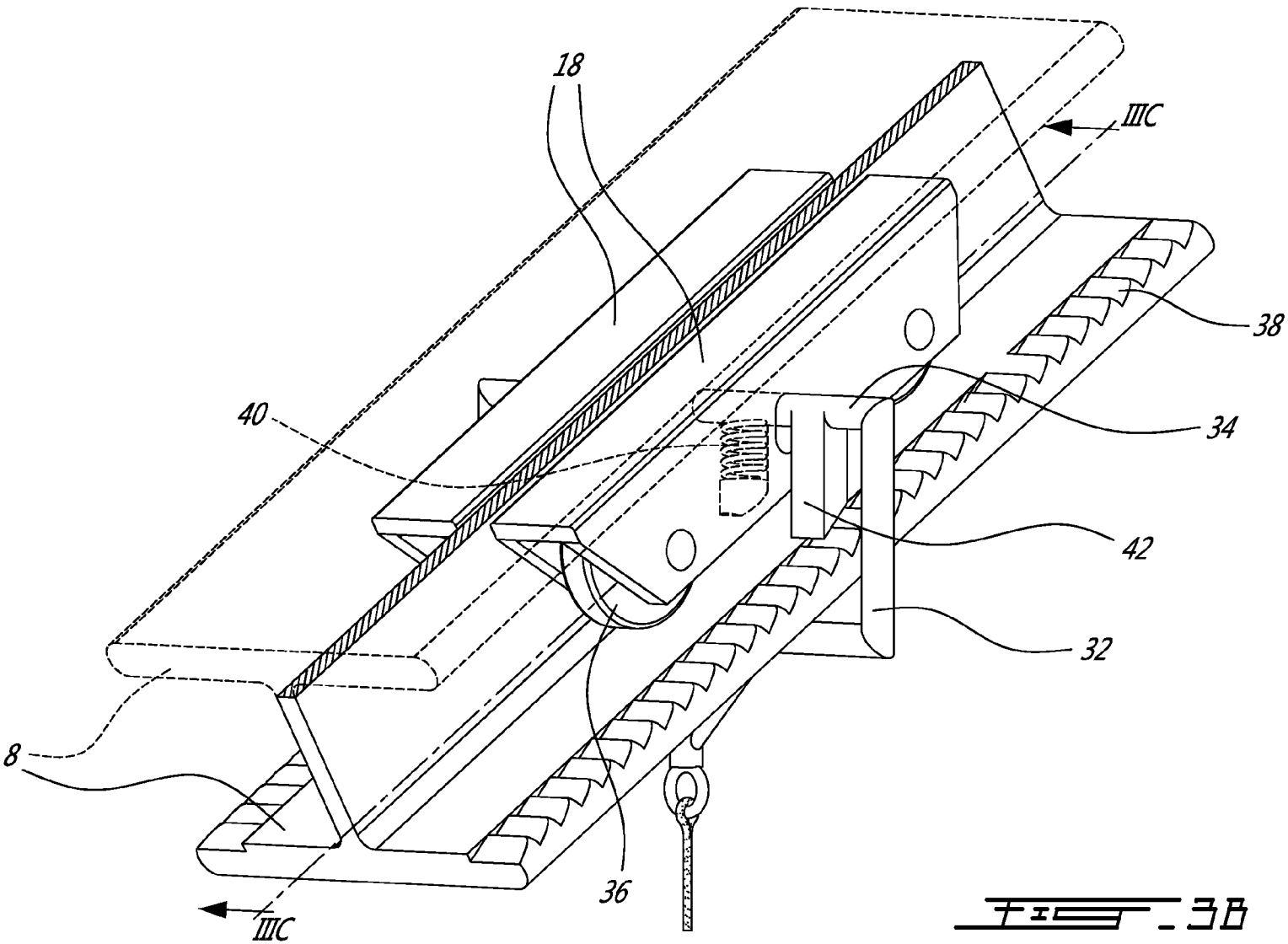
Figure 3C:
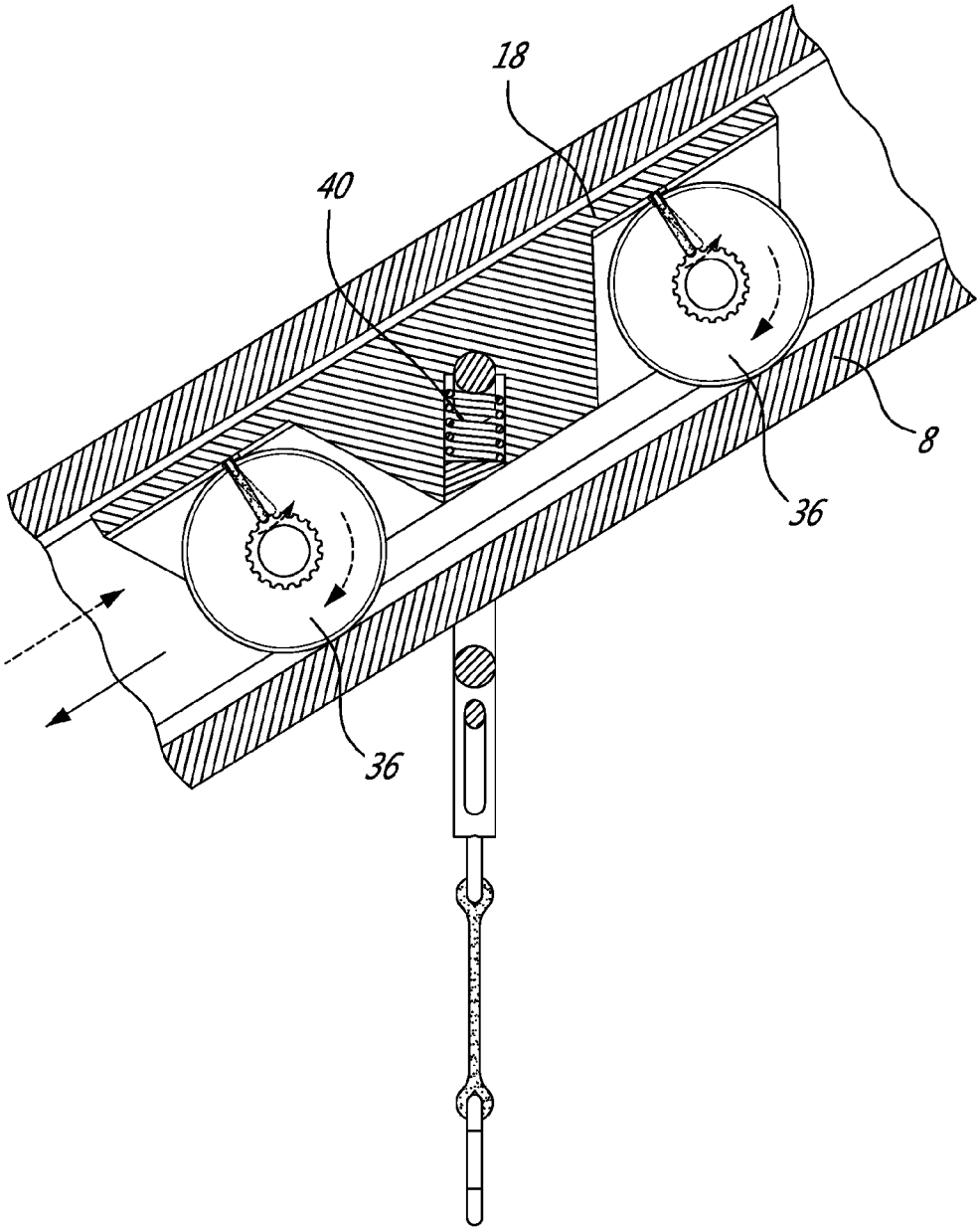
FIG. 3C is a cut side schematic view along line IIIC-IIIC in FIG. 3B.

Referring now to FIGS. 3A-3C, a plurality of teeth 38 are embedded into the top of beam 8. Carriage 18 comprises a plurality of springs 40 transferring loads from the semi-rigid rubber rod 20 to the carriage 18. Carriage 18 further comprises braking means 42, illustratively a stopper, connected to each spring 40 and adjacent to the teeth 38. In ordinary use, when there is no load acting upon the springs 40, braking means 42 are held above the teeth 38 without making contact, allowing the carriage 18 to roll freely along the beam 8 as it follows the user's 4 movements. However, if the spring 40 is subjected to the weight of the user 4, for example if the user 4 were to fall, the braking means 42 are activated and engage with the teeth 38, stopping the displacement of the carriage 18 along the beam 8. As such, the springs 40 only allow the carriage 18 to roll if no weight from the user 4 is exerted upon them. In addition, the springs 40, similarly to the elastic rope 26, aid in dampening the fall of the user 4. As such, if the user 4 were to fall, the suspension system 2 would ensure that they would not make impact with the staircase 6 but rather be gently suspended over the staircase 6 unharmed. In an embodiment, a fall detection system (not shown) is provided comprising a sensor (not shown) positioned adjacent to one of the springs 40 and configured to detect a fall of the user 4 and send an alert signal to external personnel through a wireless network (not shown), for example via a WIFI network to a mobile device.

Figure 4A:
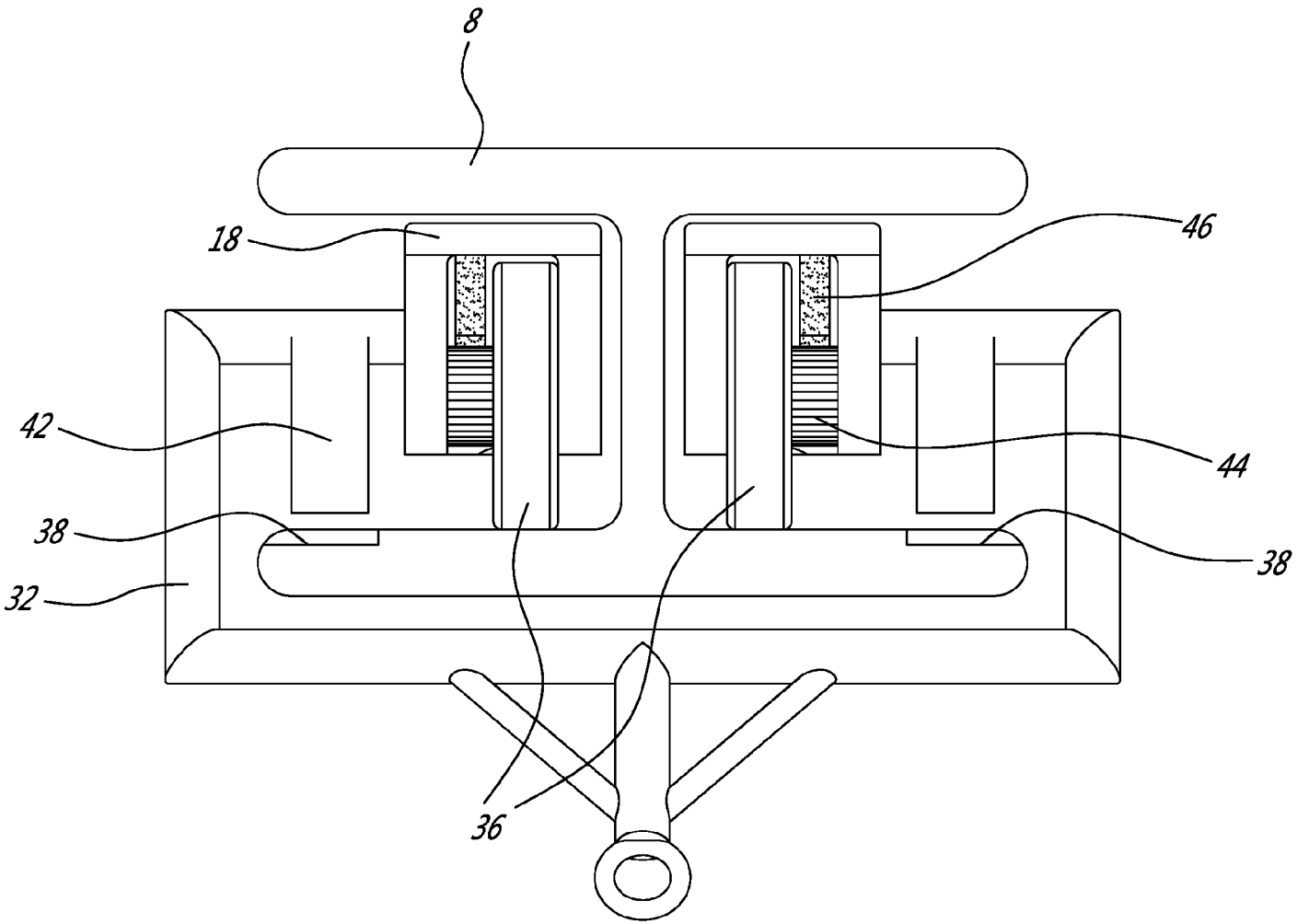
FIG. 4A is a front schematic view of a rolling carriage for a suspension system, in accordance with an illustrative embodiment of the present invention.
Figure 4B:
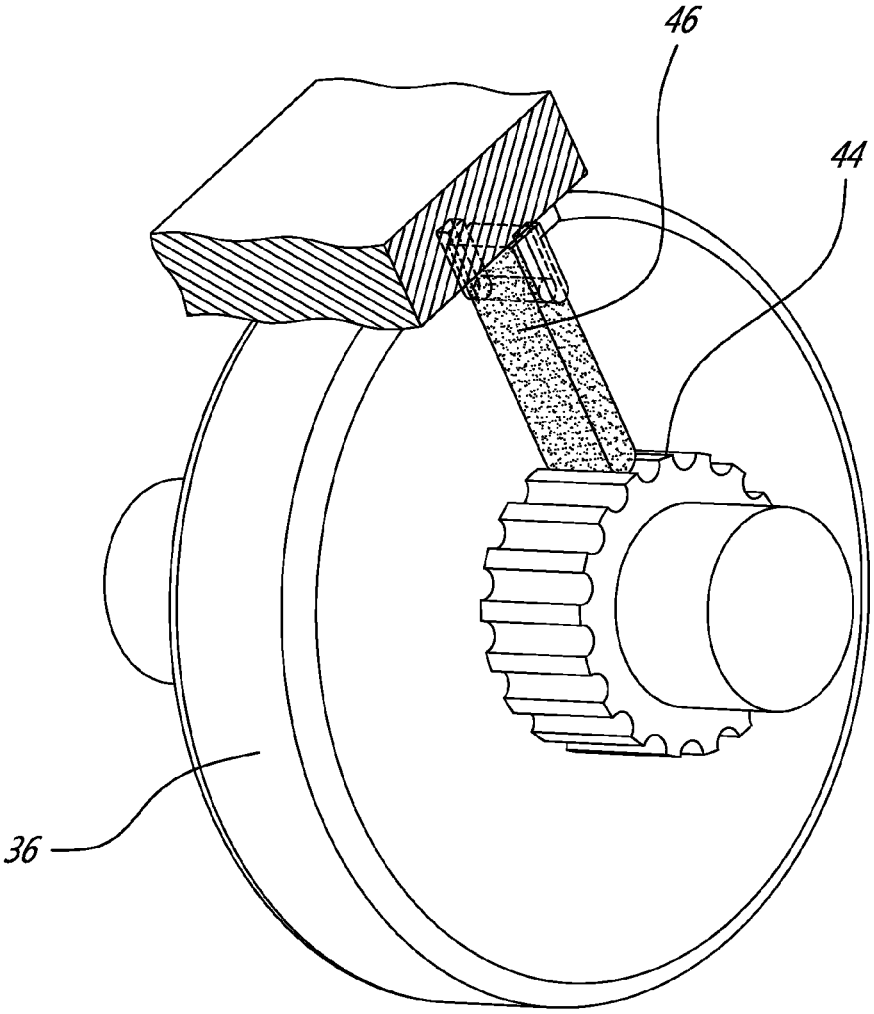
FIG. 4B is an isolated perspective schematic view of a wheel for a suspension system, in accordance with an illustrative embodiment of the present invention.

Referring now to FIGS. 4A-4B, at least one of the wheels 36 comprises an adjacent toothed wheel 44 that rotates along with its respective wheel 36. A hinged tab 46, illustratively a flexible plastic tab, sits above the toothed wheel 44 and makes contact with the teeth of the toothed wheel 44 as the toothed wheel 44 rotates for descending the stairs. The hinged tab 46 exerts enough resistance on the toothed wheel 44 to prevent the carriage 18 from unpromptedly advancing past the user 4 when the user 4 is descending the staircase 6. However, the hinged tab 46 does not apply resistance against the toothed wheel 44 when the user 4 is climbing the staircase 6. In an embodiment, each wheel 36 comprises ball bearings (not shown) to reduce rotational friction and handling stress.

Figure 5:
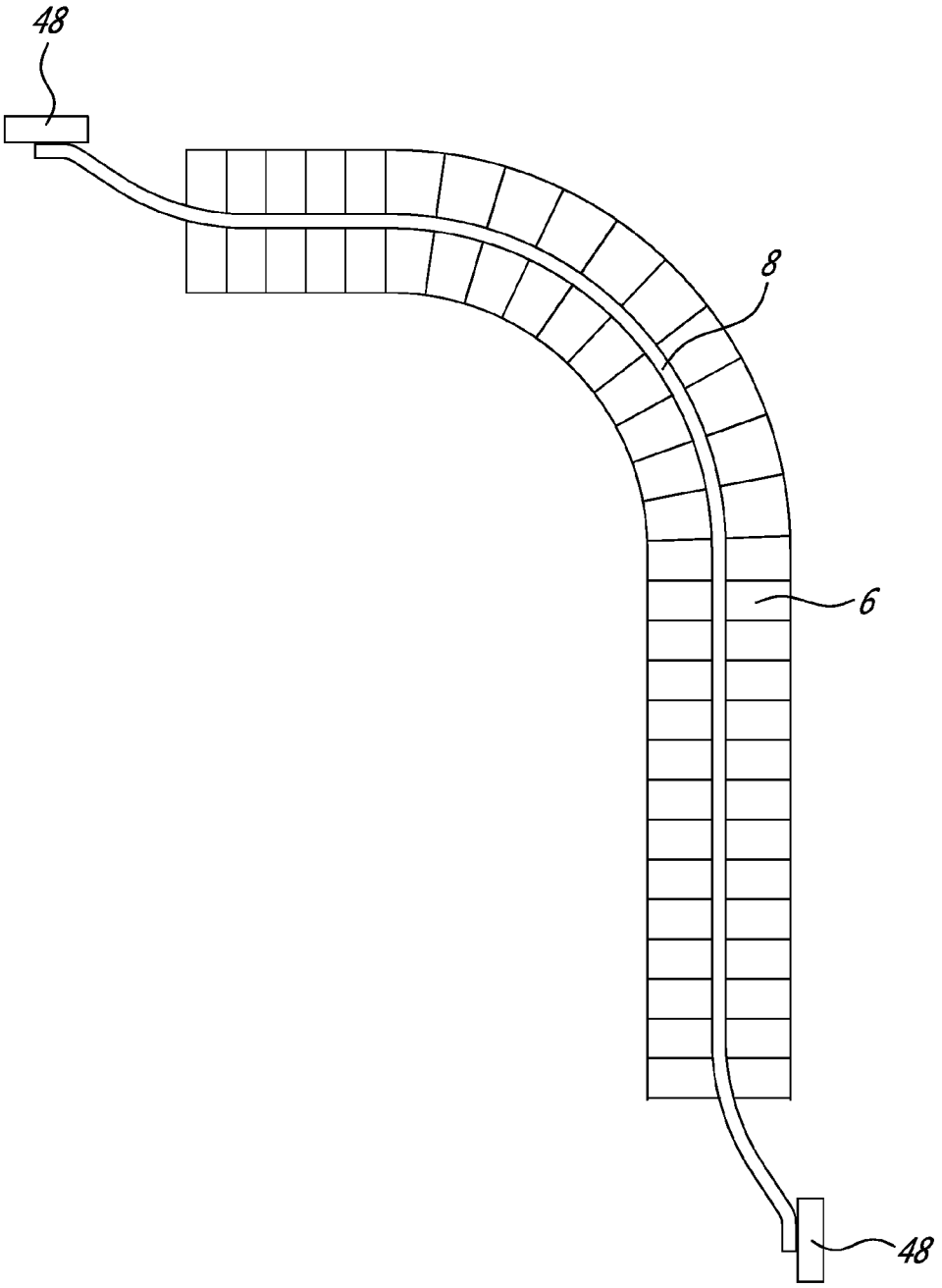
FIG. 5 is a top plan view of staircase with a suspension system, in accordance with an illustrative embodiment of the present invention.

Referring now to FIG. 5, at each end of the staircase 6 there is a storage cabinet 48. Each storage cabinet 48 is configured to house the harness 14 when the user 4 is not navigating the staircase 6. As such, when the user 4 wishes to navigate the staircase 6, they may remove the harness 14 from the corresponding storage cabinet 48 and secure it to themselves. Alternatively, the user 4 may receive assistance when putting on the harness 14. Further, in an embodiment, the beam 8 comprises a plurality of interlocking sections or modules (not shown), allowing the beam 8 to follow the pathway of the staircase 6 regardless of its shape, for example a curved staircase, an angled staircase or a spiralling staircase. Each section of the beam 8 interlocks with adjacent beam sections at their upper surfaces, allowing the carriage 18 to roll along the beam 8 smoothly. In a further embodiment, the beam 8 is positioned to be slightly off-center from the staircase 6 so that the connection means 16 are less obtrusive to the user 4 as they navigate the staircase 6.

The scope of the claims should not be limited by the preferred embodiments set forth in the examples but should be given the broadest interpretation consistent with the description as a whole.

The invention claimed is:

1. A suspension system (2) for assisting a user (4) to navigate a staircase (6), the suspension system comprising:
- a beam (8) positioned above the staircase (6);
- a carriage (18) displaceable along said beam (8) between a first position at the bottom of the staircase (6) and a second position at the top of the staircase (6);
- a harness (14) securable to the user (4), said harness (14) being operably connectable to said carriage (18) such that said carriage (18) follows the user (4) as the user (4) navigates the staircase (6); and
- a brake (42) operably connected to said carriage (18) for braking said carriage;
- wherein if the user (4) falls while navigating the staircase (6), said brake (42) stops said carriage (18) in place and the user (4) is suspended above the staircase (6) wherein said beam (8) comprises a plurality of teeth (38) embedded into said beam (8) and said carriage (18) comprises a plurality of springs (40) operatively connected to said brake (42) for transferring loads from a semi-rigid rod (20) to said carriage (18), wherein if the user (4) falls while navigating the staircase (6), said brake (42) stops said carriage (18) in place by engaging with said teeth (38).

2. The system of claim 1, wherein said beam (8) is secured to a ceiling (10) above the staircase (6) by a plurality of anchors (12).

3. The system of claim 2, wherein each said plurality of anchors (12) secures said beam (8) to said ceiling (10) via an anchor hook (28), each said anchor hook (28) latching into one of a plurality of pre-fabricated holes (30) in said beam (8).

4. The system of claim 2, wherein each one of said plurality of anchors (12) comprises a braided steel cable.

5. The system of claim 1, wherein said carriage (18) is rollable along said beam (8) via a plurality of wheels (36).

6. The system of claim 5, wherein one of said plurality of wheels (36) comprises a toothed wheel (44) rotatable along with said one of said plurality of wheels (36), said toothed wheel (44) in contact with a hinged tab (46), said hinged tab (46) exerting enough force against said toothed wheel (44) to prevent said carriage (18) from unpromptedly rolling down said beam (8).

7. The system of claim 5, wherein each one of said plurality of wheels (36) comprises ball bearings.

8. The system of claim 1, wherein said harness (14) is operably connectable to said carriage (18) via connection means (16) that comprise the semi-rigid rod (20) connected to said harness (14) via a hook (22) and at least one clamp (24) and to said carriage via an elastic rope (26), said semi-rigid rod (20) guiding said carriage (18) while the user (4) navigates the staircase (6), said at least one clamp (24) keeping said semi-rigid rod (20) substantially vertical while the user (4) navigates the staircase (6).

9. The system of claim 8, wherein said hook (22) is a resealable latch.

10. The system of claim 1, wherein a swing (32) connects said carriage (18) to an elastic rope (26), said swing (32) pivotably linked to said carriage (18) by a pivot (34).

11. The system of claim 1, wherein said brake (42) comprises a stopper.

12. The system of claim 1 further comprising a fall detection system comprising a sensor configured to detect a fall of the user (4) and to send an alert signal through a wireless network.

13. The system of claim 1, further comprising a storage cabinet (48) at each end of the staircase (6) such that said harness (14) is storable in a respective said storage cabinet (48).

14. A method for installing the suspension system of claim 1, the method comprising steps of:

securing the beam (8) to the ceiling (10) above the staircase (6);

securing the carriage (18) to said beam (8), said carriage (18) being displaceable along said beam (8) between the first position at the bottom of the staircase (6) and the second position at the top of the staircase (6); and attaching connection means (16) to said carriage (18), said connection means (16) connecting a harness (14) to said beam (8), said harness (14) to be worn by the user (4) when navigating the staircase (6) such that said carriage (18) follows the user (4).

* * * * *